US006102202A

United States Patent [19]

Jones

[11] Patent Number: 6,102,202

[45] Date of Patent: Aug. 15, 2000

[54] LOCKING GOLF BAG INSERT

[76] Inventor: Clifford Desmond Jones, 9424 S. Tulley Ave., Oak Lawn, Ill. 60453

[21] Appl. No.: 09/333,318

[22] Filed: Jun. 15, 1999

Related U.S. Application Data

[63] Continuation-in-part of application No. 08/882,847, Jun. 26, 1997, Pat. No. 5,971,146.

[51] Int. Cl.[7] ..... A63B 55/00

[52] U.S. Cl. ..... 206/315.6; 206/315.3

[58] Field of Search ..... 206/315.2, 315.3, 206/315.6; 248/96

[56] References Cited

U.S. PATENT DOCUMENTS

| | | | |
|---|---|---|---|
| 4,029,136 | 6/1977 | Jacoby | 206/315.3 X |
| 4,194,547 | 3/1980 | Sidor | 206/315.6 |
| 4,241,774 | 12/1980 | Pell . | |
| 4,332,283 | 6/1982 | Rader . | |
| 4,664,382 | 5/1987 | Palmer et al. | 206/315.6 X |
| 4,746,014 | 5/1988 | Very | 206/315.6 |
| 4,860,889 | 8/1989 | Lemieux et al. . | |
| 4,911,465 | 3/1990 | Hauer | 206/315.6 X |
| 4,944,396 | 7/1990 | Larkin | 206/315.6 |
| 5,028,909 | 7/1991 | Miller | 206/315.6 X |
| 5,060,796 | 10/1991 | Brooks, III . | |
| 5,094,345 | 3/1992 | Yonnetti | 206/315.6 X |
| 5,267,660 | 12/1993 | Kwon . | |
| 5,392,907 | 2/1995 | Blanchard et al. . | |
| 5,505,300 | 4/1996 | Joh . | |
| 5,509,531 | 4/1996 | Patrick et al. . | |
| 5,524,753 | 6/1996 | Murphy . | |
| 5,573,112 | 11/1996 | Kim . | |
| 5,582,043 | 12/1996 | McCue et al. . | |
| 5,632,690 | 5/1997 | McConville . | |
| 5,636,735 | 6/1997 | Stusek . | |
| 5,775,513 | 7/1998 | Anthony | 206/315.3 |
| 5,799,785 | 9/1998 | Hsu . | |
| 5,834,738 | 11/1998 | Wilson | 206/315.3 X |
| 5,853,086 | 12/1998 | Chang | 206/315.6 |
| 5,950,823 | 9/1999 | Flis | 206/315.3 X |
| 5,971,146 | 10/1999 | Jones | 206/315.6 X |

FOREIGN PATENT DOCUMENTS

| | | |
|---|---|---|
| 2 646 785 | 11/1990 | France . |

*Primary Examiner*—Sue A. Weaver
*Attorney, Agent, or Firm*—Thomas R. Vigil

[57] ABSTRACT

The insert for a golf bag having a generally open top and a generally closed bottom, comprises: golf club supporting structure in the bag including a compartment for each club; and a closure structure for the generally open top of the bag including an opening for each compartment and a closure member having deflectable closure sections adjacent each opening at the top of each compartment for each club.

19 Claims, 9 Drawing Sheets

LOCKING GOLF BAG INSERT

CROSS-REFERENCE TO RELATED APPLICATIONS

This application is a continuation-in-part application of U.S. application Ser. No. 08/882,847 filed Jun. 26, 1997, now U.S. Pat. No. 5,971,146.

BACKGROUND OF THE INVENTION

1. Field of the Invention

The present invention relates to a locking golf bag insert having the following features:

1. An integral security system which alerts owners if their clubs are left behind.
2. A system which protects each club from theft.
3. A system which protects the bag from theft.
4. A system which holds each club in a stable position.
5. A system which is friendly to clubs with graphite shafts.

2. Description of the Prior Art

The number of golfers in the United States has increased 7% in the last few years to approximately 26.4 million, and the average number of rounds played has increased by 14.6%. Expenditure on hard goods has increased by 26.7%. Therefore, golfers are still willing to change equipment and buy new products as they become available.

While golf bags represent approximately 8% of dollar sales for off course retailers and 4% for on course retailers, they tend to produce lower margins than other products.

Given the number of manufacturers and the range of bags that each supplies, a large inventory is required by the retailer for products that aesthetically appear quite different but essentially are the same.

While every over possible avenue in the golf industry has been explored and aggressively expanded upon in recent years, golf bag design has surprisingly remained stagnant. Any design improvements have centered around storage spaces and specialized compartments.

Figures obtained from the National Golf Foundation and Golf Shop Operations suggest that golfers are willing to pay higher prices for better quality bags. At this time, no other manufacturer offers a product with the design features of the locking golf bag insert of the present invention.

As will be described in greater detail hereinafter, the present invention relates to a golf bag insert for a golf bag assembly offering total support and protection to a plurality of golf clubs, as well as the bag itself, against theft of individual clubs or the entire bag, against loss of individual clubs arising from negligence by the owner himself/herself, against abrasion damage caused by collision with other clubs within the bag, and finally against rain entering the bag during play. The golf bag insert also provides an organized bag for ease in locating a particular club, removing and replacing the same.

Golf bag manufacturers are constantly researching the design and construction of their products in order to service the continuing advance in golf club technology. For example, within the last five years the number of clubs sold and fitted with graphite shafts and titanium heads has skyrocketed. This in turn has created or at least exacerbated certain problems, namely theft and damage. It is not uncommon for individual clubs to cost $500.00 or more these days. Damage can easily occur in the normal configuration of most gold bags, which usually have a structure placed only at the entrance of the bag to create at best six compartments. This does not offer much protection since the heads and shafts are free to bump and grind together and often can become tangled. This standard configuration does nothing to deflect rain or drizzle from entering the bag and soaking the grips of the clubs.

A variety of devices exist in the prior art to assist in organizing the interior of a golf bag. Examples of some of the analogous and non-analogous bags are disclosed in the following analogous and non-analogous U.S. patents:

| U.S. Pat. Nos. | Patentee |
|---|---|
| 4,241,774 | Pell |
| 4,332,383 | Rader |
| 5,267,660 | Kwon |
| 5,392,907 | Blanchard, et al. |
| 5,505,300 | Joh |
| 5,524,753 | Murphy |
| 5,573,112 | Kim |
| 5,799,785 | Hsu |
| 5,582,043 | McCue |
| 5,636,735 | Stusek |

The Pell U.S. Pat. No. 4,241,774 discloses a foam disc with attached tubes that can be attached inside a golf bag.

The Blanchard et al. U.S. Pat. No. 5,392,907 discloses a series of hexagonal tubes forming a honeycomb pattern which can be encased within a golf bag.

The Rader U.S. Pat. No. 4,332,283 discloses an organizer which utilizes tubes that do not require reinforcing.

These devices in today's market are all but obsolete due to operational deficiencies and the change in today's club characteristics.

Other prior art shows the development of similar organizers using soft cloth separators as opposed to the harsher plastic tubes previously cited.

The Joh U.S. Pat. No. 5,505,300 discloses a divider insert which has a plurality of elongated enclosures and hinge flaps which can be used to separate club heads.

The Kwon U.S. Pat. No. 5,267,660 describes an interesting organizer, which has a series of plates which can be used in different configurations.

These devices, while certainly an improvement over the previous golf bags, must be manually operated and require decisions to be made by the golfer in order to be efficient. Their range of protection is also limited.

The Kim U.S. Pat. No. 5,573,112 shows yet another organizer using a cloth interior. This organizer, while preferred, does not solve the main problem associated with organizer bags, i.e. each club in a set of golf clubs has a different length, and so, even if one separates the shafts of each club by giving each club its own compartment, the head of a shorter club can strike the unprotected area of a shaft of a longer club.

The Hsu U.S. Pat. No. 5,799,785 uses a partitioning rack and a club holding member to secure the club head. Again, this design has a number of deficiencies in that it does not utilize the space inside the bag very well. A very large bag would be required in order to accommodate the partitioning rack. It does not accommodate wooden headed clubs which are normally found in a full set of clubs and has no protection against theft.

While the security devices disclosed in the Murphy U.S. Pat. No. 5,524,753, the McCue U.S. Pat. No. 5,582,043 and the Stusek U.S. Pat. No. 5,636,735 undoubtedly perform the task for which they were intended, they all have limitations which reduce their effectiveness.

Other devices known in the industry suffer from similar limitations which include but are not limited to, ease of operation, the device itself can in certain circumstances cause damage, and range of protection. For example, the Stusek U.S. Pat. No. 5,636,735 discloses a device which protects the clubs in an efficient manner but fails to protect the bag itself.

All the aforementioned patents describe devices which are unquestionably beneficial, however, they all operate within limited parameters and solve only certain problems. It is the object the present invention to encompass all described problems and some other difficulties that the prior art has not yet addressed. In this respect, the locking golf bag insert of the present invention offers a wide range of protection for problems previously investigated and also provides for concepts not previously anticipated.

SUMMARY OF THE INVENTION

According to the present invention there is provided an insert for a golf bag having a generally open top and a generally closed bottom, the insert composing: golf club supporting structure in the bag including a compartment for each club; and a closure structure for the generally open top of the bag having an opening for each compartment and including a closure member having deflectable closure sections adjacent each opening at the top of each compartment for each club.

DESCRIPTION OF THE PREFERRED EMBODIMENT(S)

Figure 1:
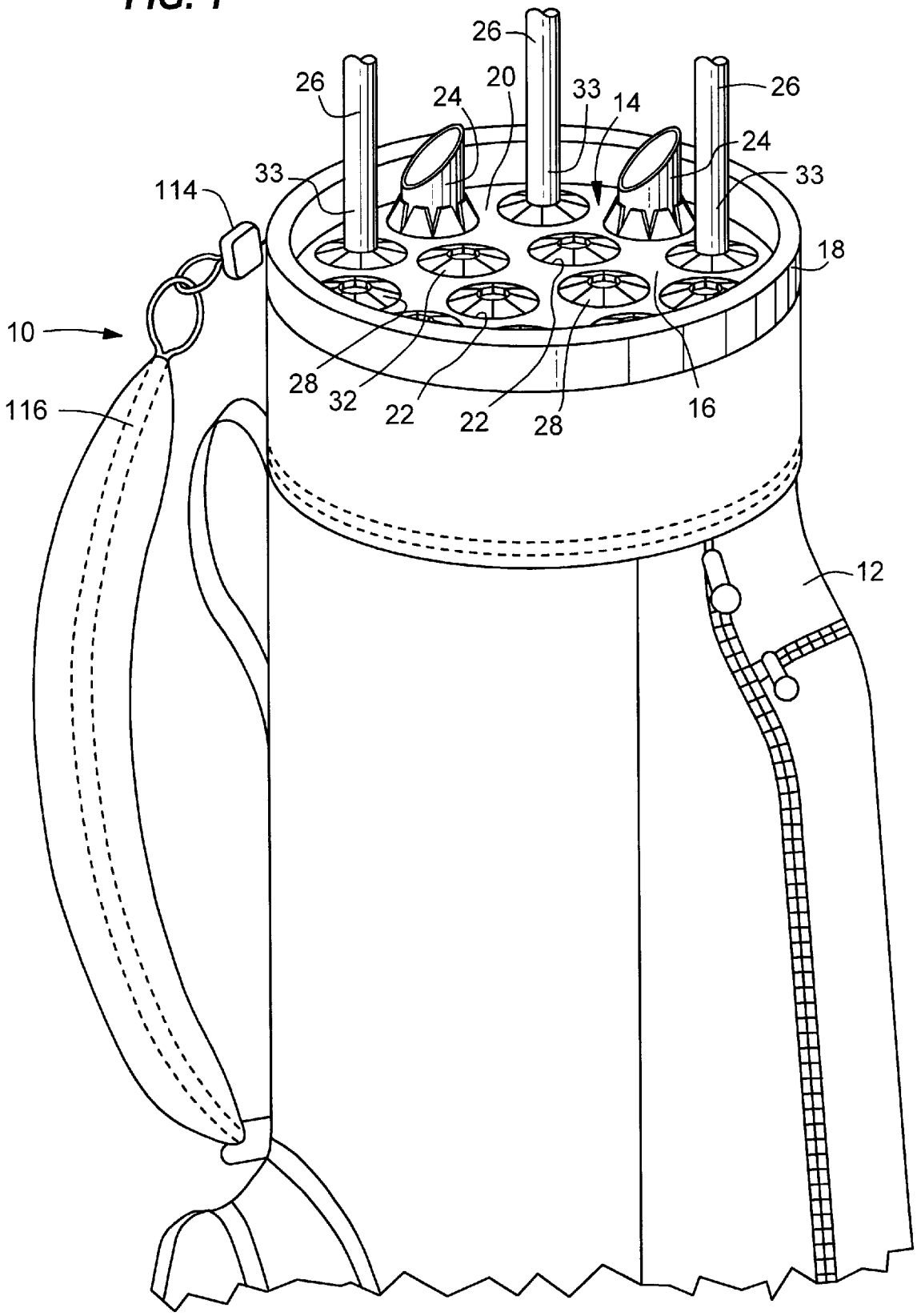
FIG. 1 is a perspective upper view with portions broken away of a golf bag having the golf bag insert of the present invention received therein.

Referring now to the drawings in greater detail, there is illustrated in FIG. 1 a golf bag assembly 10 including a golf bag 12 and a golf bag insert 14 (FIG. 3) constructed according to the teachings of the present invention.

An upper end 16 of the insert 14 of the present invention, is shown at a top 18 of the bag 12 and includes a bag closure structure 20 in the top 18 with a plurality, e.g. fourteen (14), openings 22, for receiving fourteen (14) tubular compartments or tubes 24 respectively each receiving one of fourteen (14) differing golf clubs 26 and with each opening 22 having an inverted cup-shaped closure member 28 (FIGS. 5 and 7) mounted therein.

Figure 2:
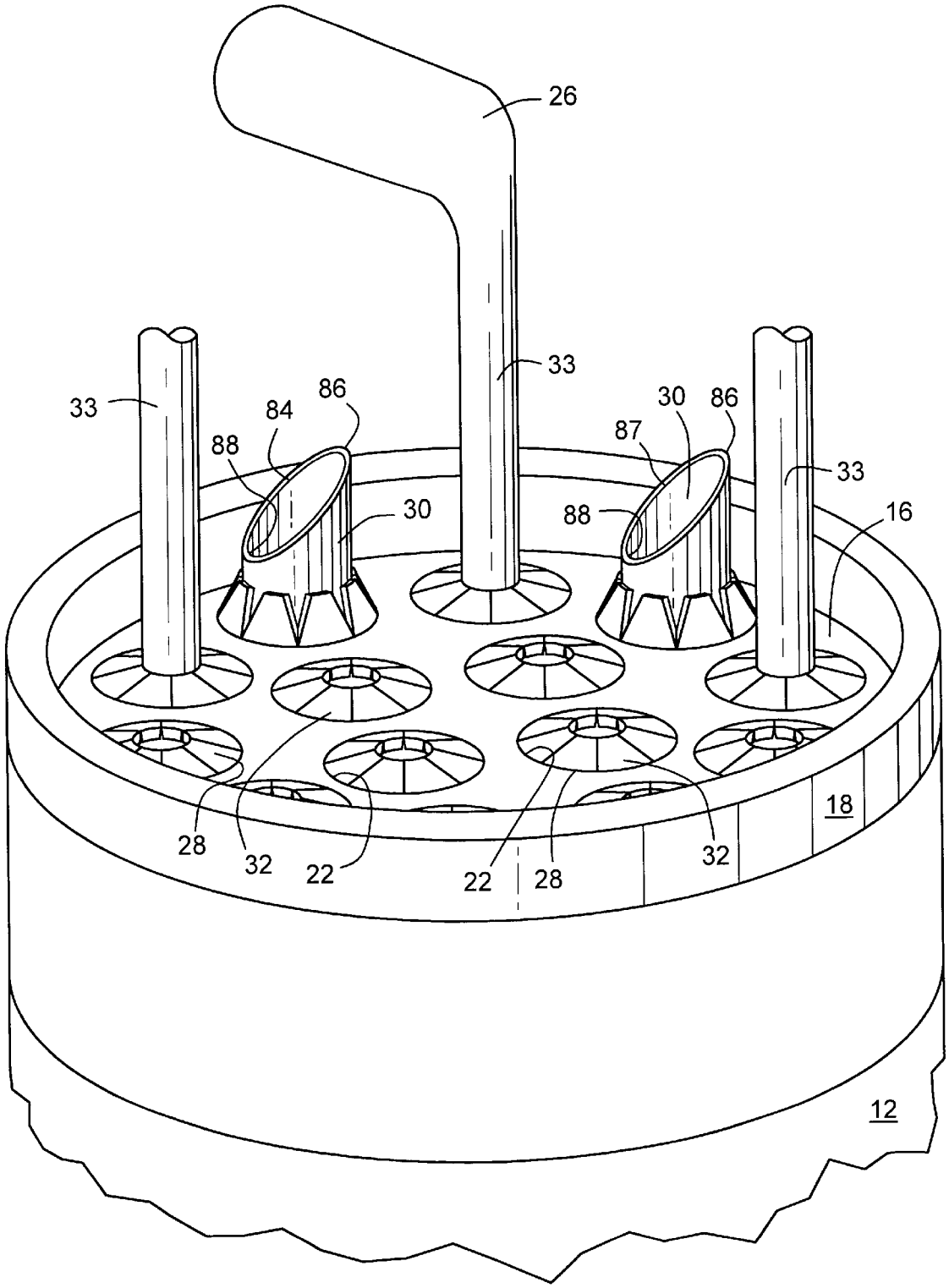
FIG. 2 is an enlarged fragmentary upper view of the golf bag and golf bag insert shown in FIG. 1.

In FIG. 1, only three golf clubs 26 are shown extending through the closure members 28 in the openings 22 in the closure structure 20 and only two upper end sections 30 of a tubular compartment or tube 24 are shown extending through the closure members 28, although it is to be understood that the closure members 28 shown in FIGS. 1 and 2 will not normally be closed without a golf club 26 therein. Instead upper end sections 30 of the tubular compartments or tubes 24 will extend through the closure members 28 not having a club 26 therein.

As shown in FIG. 2, there are fourteen (14) cup-shaped closure members 28 for the fourteen (14) openings 22 in the closure structure 20 through which golf clubs 26 are received.

Figure 7:
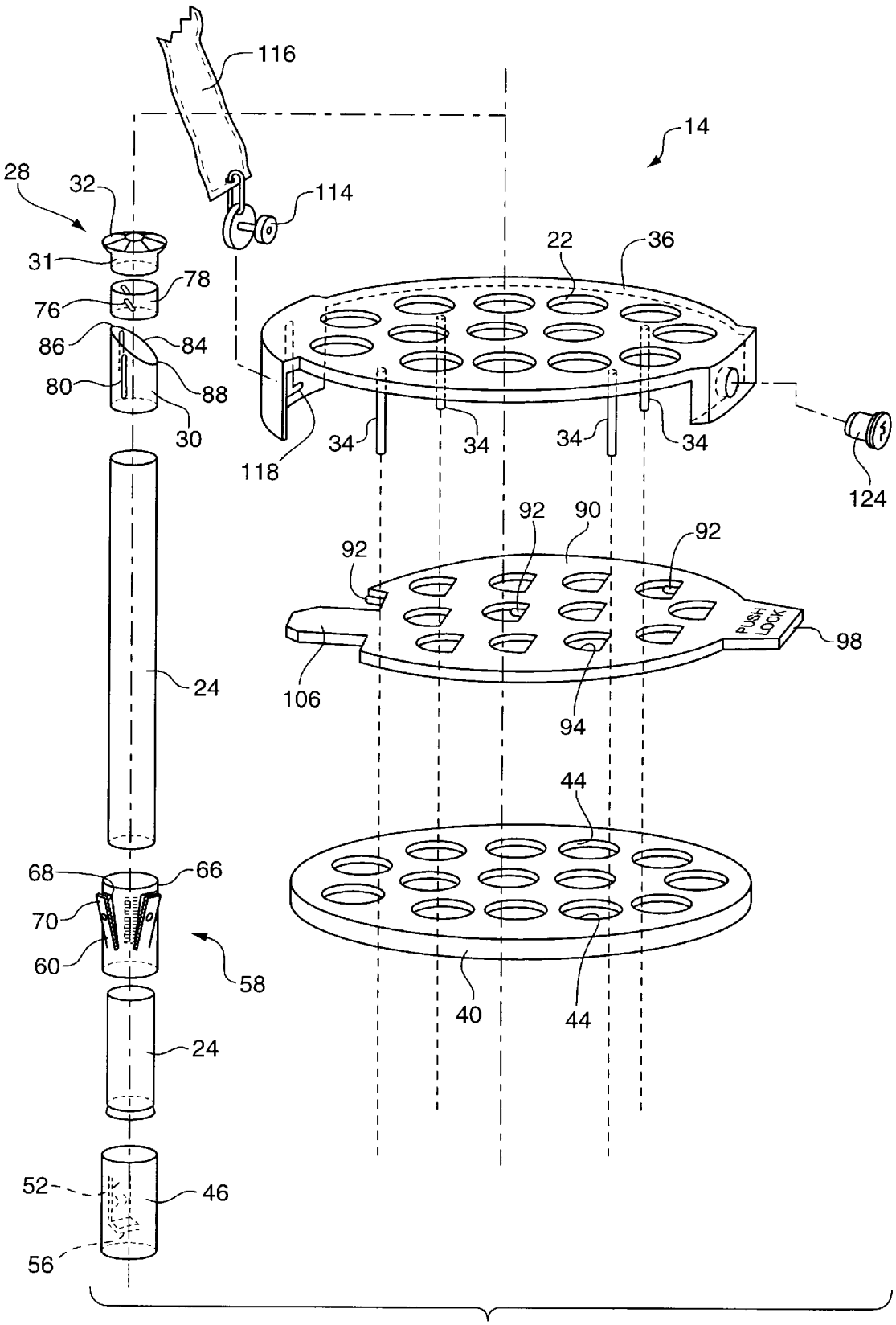
FIG. 7 is an exploded perspective view of some of the parts of the golf bag insert shown in FIGS. 3 and 4 and in particular shows upper and lower plates with holes therein for mounting the tubular compartments, a locking plate which is slidable under the upper plate and one tubular compartment with the parts thereof shown in exploded view.

It will be appreciated from FIGS. 2 and 7, that each closure member 28 has a plurality, namely six (6) or eight (8) pie-shaped or wedge-shaped sections 32 which are hingedly connected to a cylindrical sleeve 31 and which can be deflected upwardly when an upper section 30 of a tubular compartment or tube 24 is raised when removing a club 26 and which fold downwardly around a shaft 33 of a club 26 when the club 26 is reinserted into a tube 24 and the tube 24 is pushed downwardly.

Figure 3:
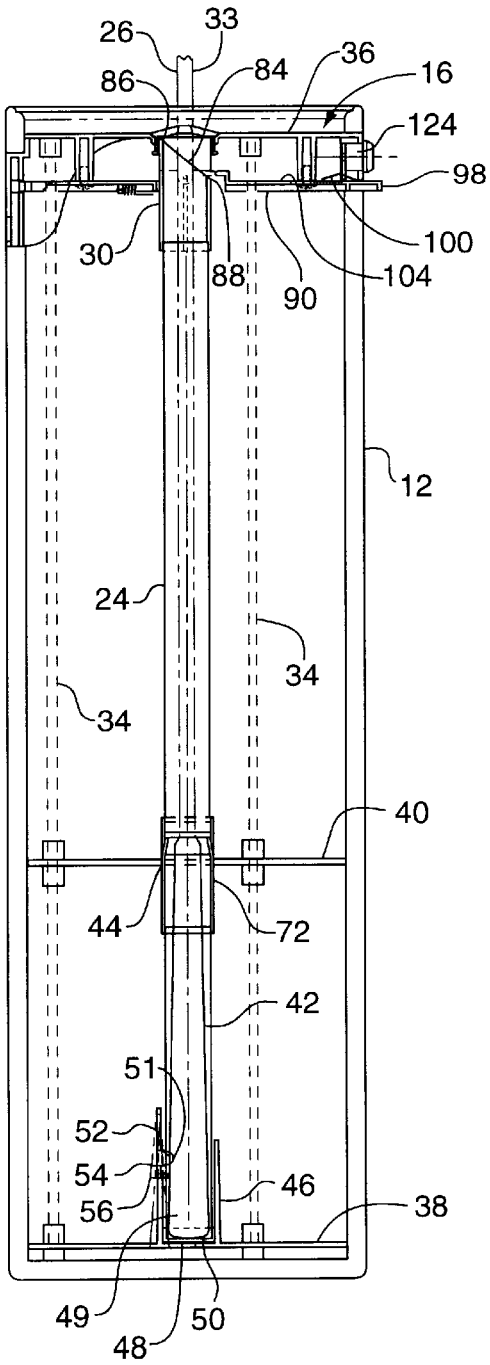
FIG. 3 is a longitudinal fragmentary sectional view of the golf bag insert of the present invention showing one tubular compartment of the golf bag insert.

Referring now to FIG. 3, there is illustrated therein a vertical sectional view through the golf bag 12 and through the golf bag insert 14. In this view, only one of the fourteen (14) tubular compartments or tubes 24 is shown. Also shown are two of three support rods 34 which extend between an upper plate 36 of the bag closure structure and a lower or bottom plate 38. The golf bag insert 14 insert also includes an intermediate plate 40 located a short distance above the bottom plate 38, a distance equal to approximately the length of a golf club grip 42.

The intermediate plate 40 has fourteen (14) openings 44 therein, each opening 44 having a cylindrical wall which will engage with a tubular compartment or tube 24.

Figure 4:
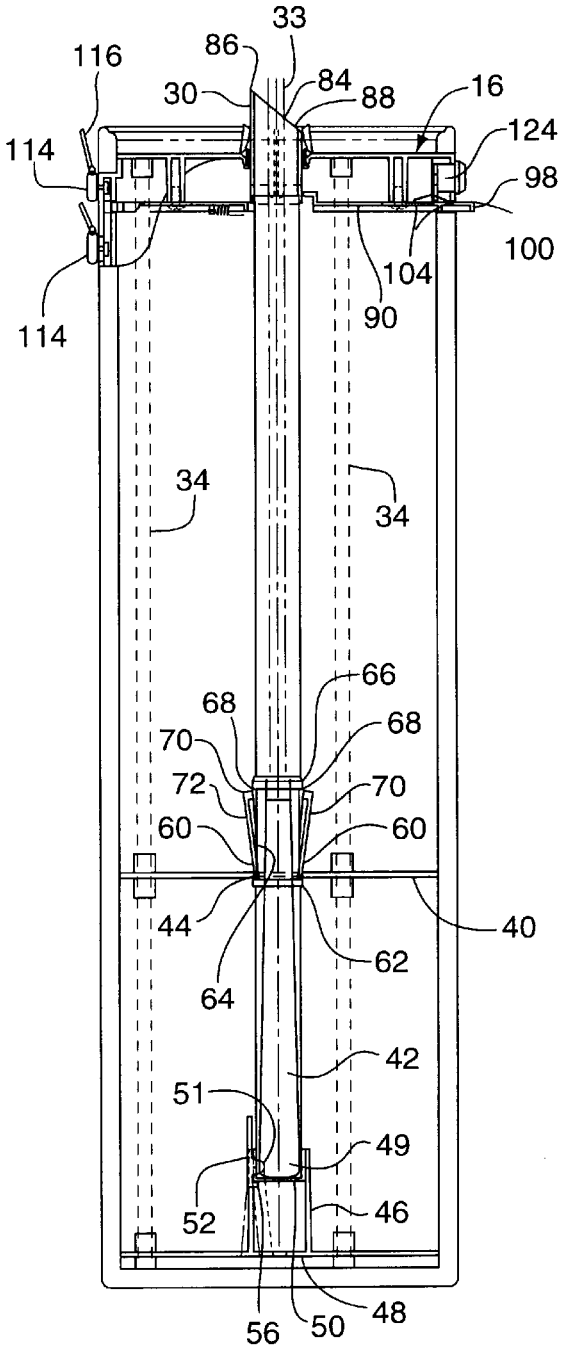
FIG. 4 is a longitudinal fragmentary sectional view of the golf bag insert of the present invention similar to the view shown in FIG. 3 but showing a tubular compartment in a raised position.

As shown in FIGS. 3 and 4, each tubular compartment or tube 24 is received in a short cylinder 46 fixed to the bottom plate 38.

When a tubular compartment or tube 24 is pushed all the way down into the short cylinder 46, it will bottom at a bottom 48 of the short cylinder 46. This will occur when a lower end 49 of a golf club grip 42 is inserted into a tubular compartment or tube 24 and dropped to a bottom 50 of the tubular compartment or tube 24 where the grip 42 will first deflect a protrusion 51 extending radially inwardly from a deflectable member 52 mounted in and forming part of a wall of the short cylinder 46. A lower end 54 of the deflectable member 52 is L-shaped so as to provide a radially inwardly extending flange 56 which is adapted to extend beneath the bottom 48 of the tubular compartment or tube 24 when the tube 24 is raised.

This deflectable member 52 with the protrusion 51 and the flange 56 cooperate with a golf club grip 42 and the tubular compartment or tube 24 for preventing a tubular compartment 24 form being lowered into the short cylinder 46 after a golf club 26 is removed from the tubular compartment or tube 24. This is because, without engagement by a grip 42 with the protrusion 51, the flange 56 is positioned under a bottom 50 of a tubular compartment or tube 24.

Grip latching structure 58 is provided in the tubular compartment or tube 24 and cooperates with the annular wall defining each opening 44 in the intermediate plate 40 of the golf bag insert 14. The grip latching structure 58 includes at least two, and preferably three or four, opposed flexible members 60 each mounted at a lower end 62 thereof to the bottom of a longitudinal slot 64 in a cylindrical wall 66 of each tubular compartment or tube 24. An inwardly extending protrusion 68 made of a soft material, e.g. a soft plastic, is mounted to an upper end 70 of each flexible member 60 and each flexible member 60 extends upwardly and radially outwardly of one of the slots 64.

In this respect, it will be understood that when a golf club 26 is inserted into a raised tubular compartment or tube 24, as shown in FIG. 4, the flexible members 60 in the wall 66 of the tubular compartment or tube 24, which are normally biased radially outwardly, will be moved inwardly when they engage the cylindrical wall of the opening 44 in the intermediate plate 40 and toward the grip 42 of the club 26 received in that tubular component or tube 24 and engage a tapered upper end 72 of the grip 42 to allow the club 26 to be inserted completely to the bottom 48 of the tubular compartment or tube 24 and locked by the grip latching structure 58 in the tubular compartment or tube 24.

Pushing the tubular compartment or tube 24 downwardly, causes the bottom 49 of the grip 42 to engage the protrusion 51 and push the lower deflectable members 52 in the short cylinder 46 rearwardly outwardly, as shown in FIG. 3. At the same time, the deflectable members 60 in the wall 66 of the tubular compartment or tube 24 are moved inwardly as the tubular compartment 24 moves within the opening 44 in the plate 40 and the annular wall thereof engages the outer surface of the deflectable members 60 and pushes them inwardly thereby to push the protrusion 68 at the upper end 70 of each deflectable member 60 against the upper tapered end portion 72 of the grip 42 and thereby hold the grip 42 in the tubular compartment 24. This locks the golf club 26 in the tubular compartment or tube 24 so that one cannot pull the golf club 26 upwardly without also pulling the tubular compartment or tube 24 upwardly.

Now, when the tubular compartment 24 and golf club 26 are pulled upwardly, the golf club 26 first will move with the tubular compartment 24, since the protrusions 68 on the deflectable members 60 are engaging the upper tapered portion 72 of the grip 42 until the golf club 26 and tubular compartment 24 are in the position shown in FIG. 4, where the protrusions 68 no longer engage the grip 42 of the golf club 26 which then can be pulled out of the tubular compartment 24.

Figure 11:
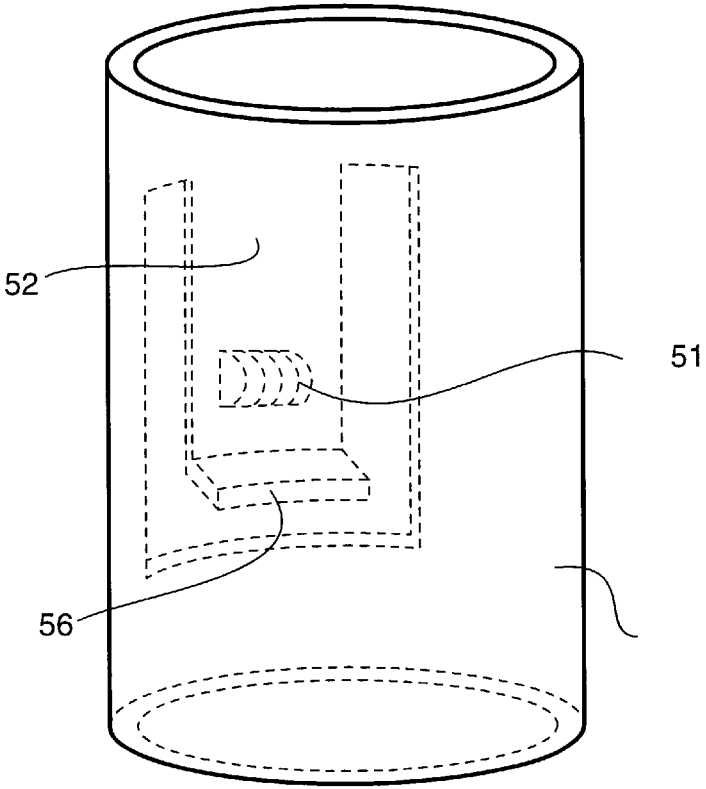
FIG. 11 is a view similar to the view shown in FIG. 10 of the locking mechanism for locking the bottom of the tubular compartment in a slightly raised position and shows the locking mechanism as it is shown in FIG. 4.
Figure 10:
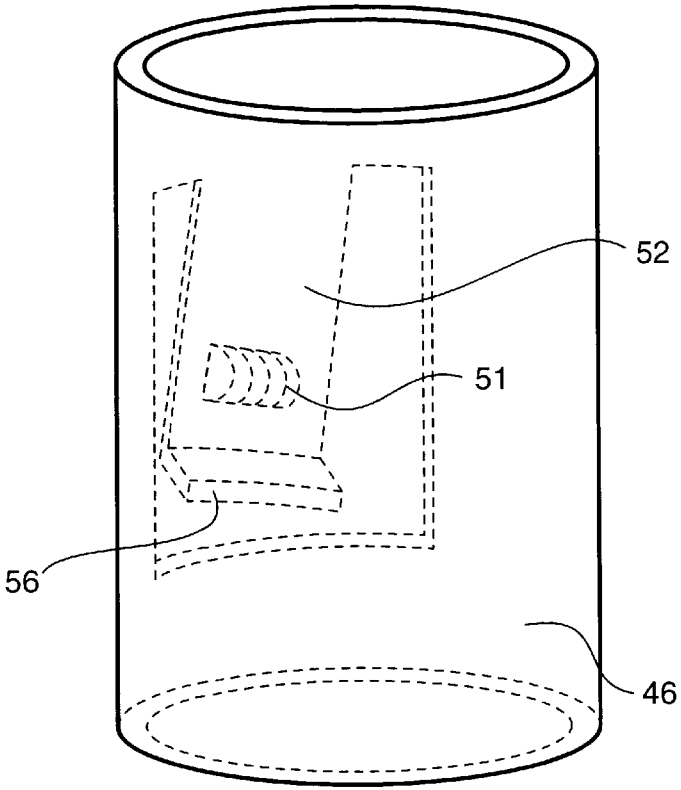
FIG. 10 is a perspective view of a locking mechanism for the bottom of a tubular compartment showing the locking mechanism in the position shown in FIG. 3 where the tubular compartment is bottomed in the golf bag insert.

When this is done, the protrusion 51 on the lower deflectable member 52 in the short cylinder 46 will protrude into the short cylinder and a lower end of the tubular compartment 24, just above the bottom 50 thereof, as shown in FIGS. 4 and 11. This protrusion 51 may engage the bottom wall of the tubular compartment or tube 24 to assist in preventing further upward movement of the tubular compartment or tube 24 which upward movement is constrained primarily by two pins 76 mounted on a collar 78 which is fixed to the cylindrical sleeve 31 and received in slots 80 in the upper end section 30. As shown, the pins 76 are received in slots 80 in the upper section 30 and the collar 78 is received in and fixed to the cylindrical sleeve 31 of a cup shaped closure member 28.

An upper end 81 of each slot 80 limits movement of one of the pins 76. A lower end 82 of each slot 80 limits the upper movement of the tubular compartment or tube 24.

When a golf club 26 has been inserted into a tubular compartment 24 and pushed all the way down to the bottom 48 of the tubular compartment 24 thereby deflecting protrusions 51 causing the flange 56 to be moved radially outwardly from the bottom of the tubular compartment 24 and allow the tubular compartment to travel to its bottom position shown in FIG. 3.

Because the upper end section 30 is permanently fixed to the tubular compartment 24, as the tubular compartment 24 is pushed downwardly, the upper end section 30 also moves downwardly. As the travel of the tubular compartment 24 and hence the upper end section 30 also, nears the bottom of the bag 12, the upper ends 81 of the slots 80 reach the pins 76, just as the upper end section 30 falls below the top closure structure 22 and plate 36. The final downward movement of the tubular compartment 24 causes a pulling effect on the cylindrical sleeve 31 of the closure member 28 which causes an upper angular flange 83 at the top of the cylindrical sleeve 31 to engage the upper plate 36 in the area around each opening 22 to cause the pie-shaped sections 32 to pivot downwardly to close the opening 22 and engage the shaft 33 of a club 26. A pulling pressure is also exerted on the pins 76 by the upper ends 81 of the slots 80 thereby pulling the closure member 28 downwardly.

As shown, a lower annular flange 85 extends outwardly from the cylindrical sleeve 31 in a position to engage the underside of the upper plate 36 in the area around an opening 22 when a club 26 and tubular compartment 24 are pulled upwardly to limit upward movement of the cylindrical sleeve 31 of each closure member 28.

Also when the tubular compartment or tube 24 moves downwardly, the flange 56 at the bottom end of the deflectable member 52 in the short cylinder 46 moves under the bottom 50 of the tubular compartment or tube 24, as shown in FIG. 4.

At this point in time, the tubular compartment or tube 24 is locked in the position shown in FIG. 4 where an upper end section 30 of the tubular compartment 24 extends a short distance above the deflected pie-shaped sections 32 of a closure member 28 and the tubular compartment or tube 24 cannot be raised or lowered until a golf club 26 is reinserted into the tubular compartment 24. The upper end section 30 is preferably color coded, e.g. colored orange, to contrast with a black or brown golf bag 12.

As shown in FIGS. 2, 4, 5 and 6, an upper edge 84 of each upper section 30 of each tubular compartment or tube 24 is an inclined edge 84 extending downwardly from a point 86 to a round 88. This facilitates upward movement of the tubular compartment or tube 24 against the deflectable pie-shaped sections 32 to deflect same upwardly as the golf club 26 and inter-engaged tubular compartment 24 are pulled upwardly.

Figure 5:
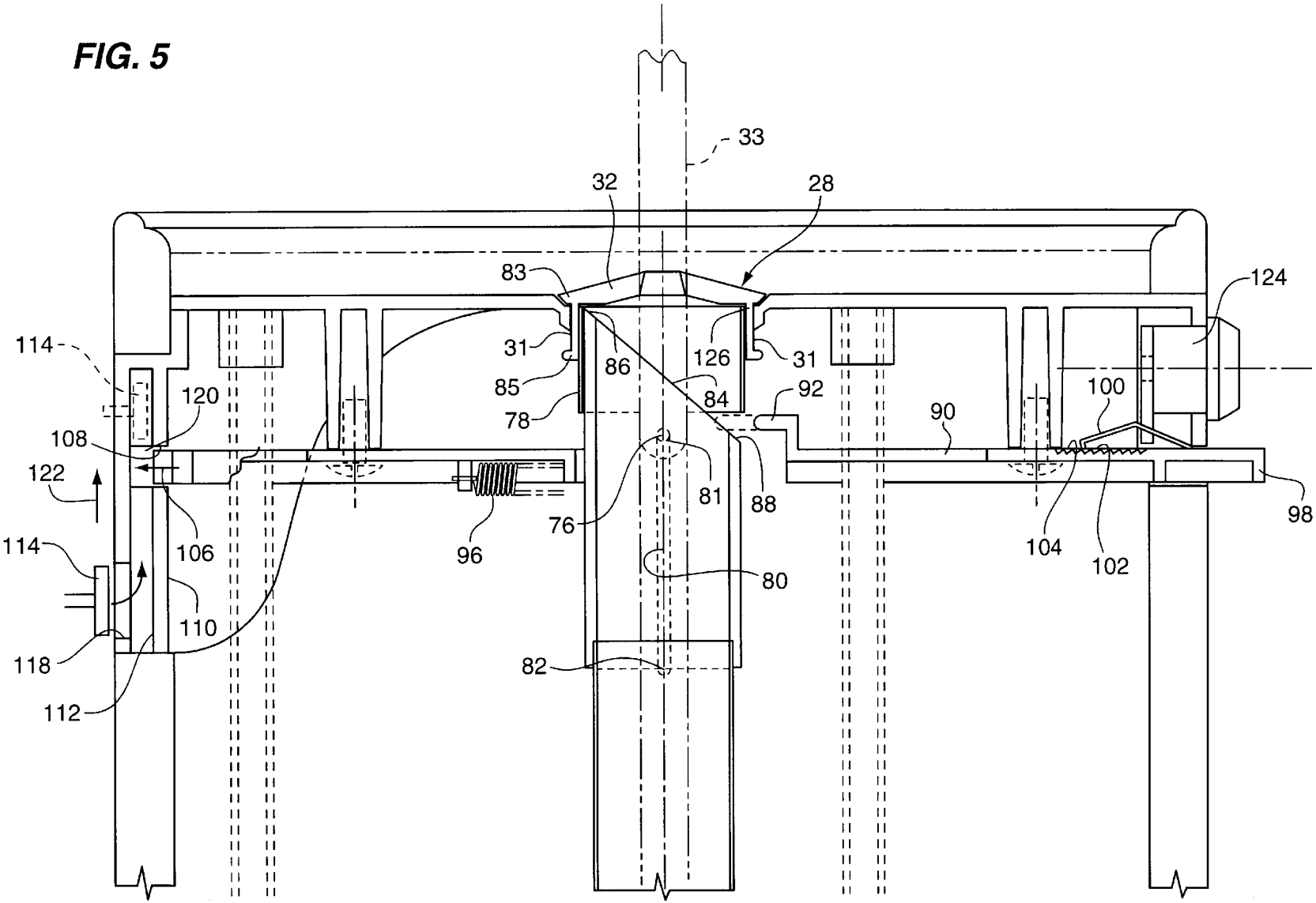
FIG. 5 is an enlarged view of the upper portion of the golf bag insert shown in FIG. 3.
Figure 6:
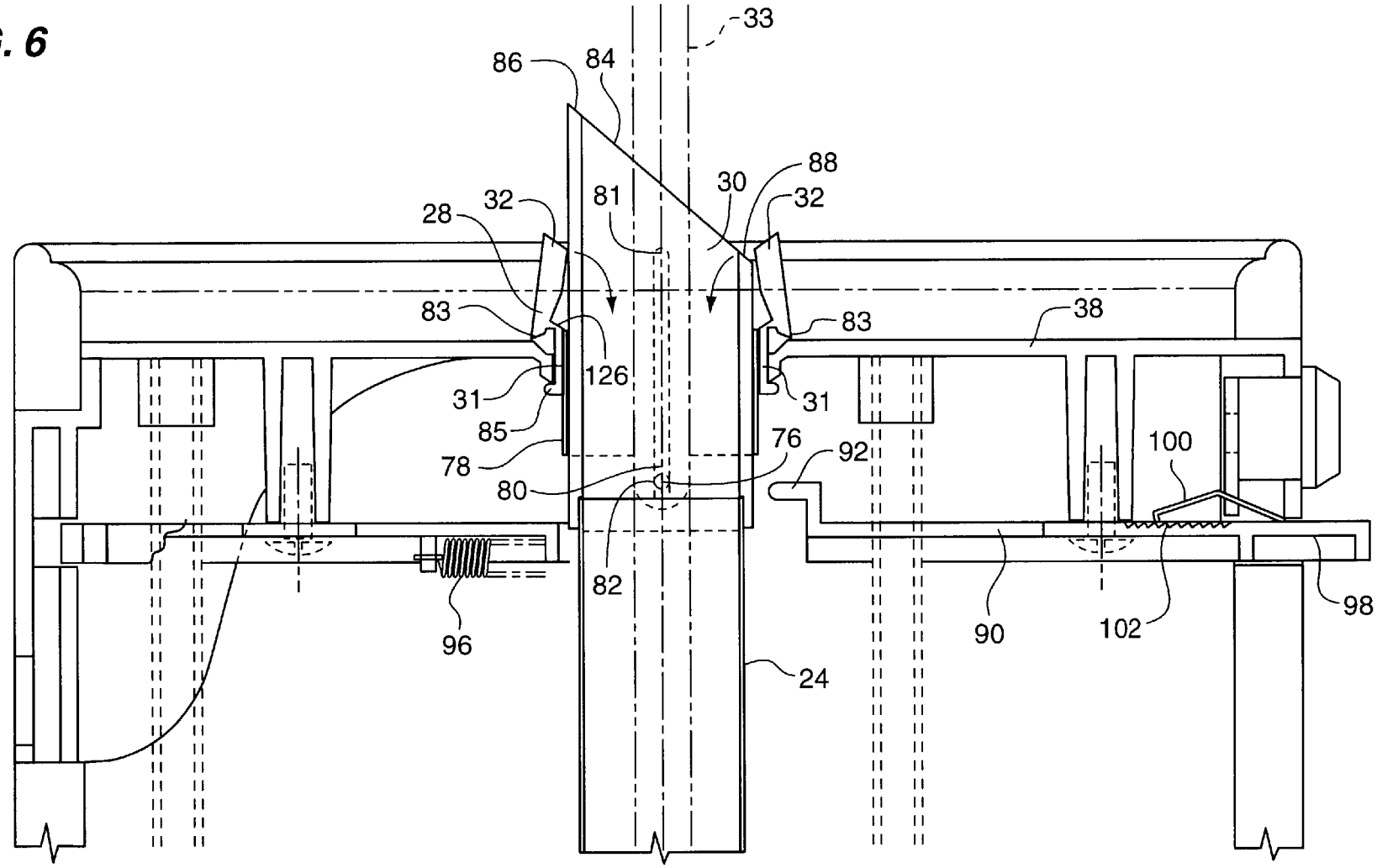
FIG. 6 is an enlarged view of the upper portion of the golf bag insert shown in FIG. 4.

When the tubular compartment 24 is in the lower position shown in FIG. 3, a locking plate 90, as best shown in FIGS. 3, 5 and 6, can be moved transversely across the golf bag insert 14 so that a plurality of edges or tabs 92 adjacent one of fourteen (14) openings 94 in the locking plate 90 can be moved over the round 88 or lower side 88 of the inclined upper edge 84 of each upper section 30 of each tubular compartment 24, as best shown in FIG. 5. In this way, the golf clubs 26 and tubular compartments 24 are prevented from being pulled upwardly, as shown in FIG. 7.

Referring now to FIGS. 5 and 6 in greater detail, it will be seen that the locking plate 90 is urged by a spring 96 from an outer, non-locking position shown in FIG. 5 where a finger gripping portion or handle 98 extends horizontally outwardly from the golf bag 12. In this way, the locking plate 90 can be engaged and pushed inwardly across the bag 12 and insert 14 with the spring 96 pulling the locking plate 90 inwardly. A ratchet spring member 100 engages a saw-tooth area 102 on an upper portion 104 of the locking plate 90 to allow the locking plate 90 to be ratcheted while being pulled outwardly against the action of the spring 96 to pull the edges or tabs 92 away from a locking position over the round or lower side 88 of the inclined edge 84. At the same time, an outer end tab 106 of the locking plate 90 is moved out of an opening 108 in a wall structure 110 fixed to the upper plate 36. The wall structure has a slot 112 therein and the opening 108 opens into the slot 112 and allows a latch member 114 (FIG. 1) at the end of an arm strap or sling 116 of the golf bag 12 to be inserted through an outer opening 118 in the wall structure 110 into the slot 112 and then upwardly in the slot 112 above the opening 108 for positioning the latch member 114 in a position to be locked to the insert 14 when the end tab 106 is moved into the opening 108 and across the slot 112 beneath the latch 114 to lock the strap 116 of the bag 12 to the bag 12 with the strap received around a bar (not shown) for locking the golf bag 12 to the bar. The latch member 114 is shown in phantom in the locked position in FIG. 5 and the position of the outer end tab 106 of the locking plate 90 for latching the latch member 114 in the slot 112 is indicated by the arrow 120. The direction of insertion of the latch member 114 is indicated by the arrow 122 in FIG. 5.

Further, there is provided a key operated lock 124 for locking the locking plate 90 in its inner latching and locking position where the outer end tab 106 extends across the slot 112 and the tabs 92 are located above the rounds or lower sides 88 of the inclined edges 84 of each tubular compartment or tube 24. In this way, the tubular compartments 24 and the latch member 114, as well as the golf clubs 26 in the tubular compartments 24, are latched to the bag 12 and the bag 12 can be latched to a bar (not shown).

As shown in FIGS. 5, 6 and 7, each collar 78 is received in each closure member 28 and the two pins 76 that extend inwardly from the collar 78 (FIG. 7) are received in longitudinal slots 80 in an upper end section 30 of the tubular compartment 24. This provides for proper movement and alignment of the upper end section 30 of the tubular compartment 24 through the collar 78 for engagement with the deflectable pie-shaped sections 32.

Further, it will be understood from FIGS. 5, 6 and 7, that the closure member 28 comprising the pie-shaped or wedge-shaped sections 32 is part of the cup-shaped closure member 28 having the cylindrical sleeve 31 to which each pie-shaped section 32 is connected by a living hinge 126, best shown in FIG. 6, which allows the pie-shaped sections 32 to be deflected upwardly when the upper end section 30 of the tubular compartment or tube 24 having the inclined upper edge 84 is moved upwardly, as shown in FIGS. 5 and 6.

Figure 8:
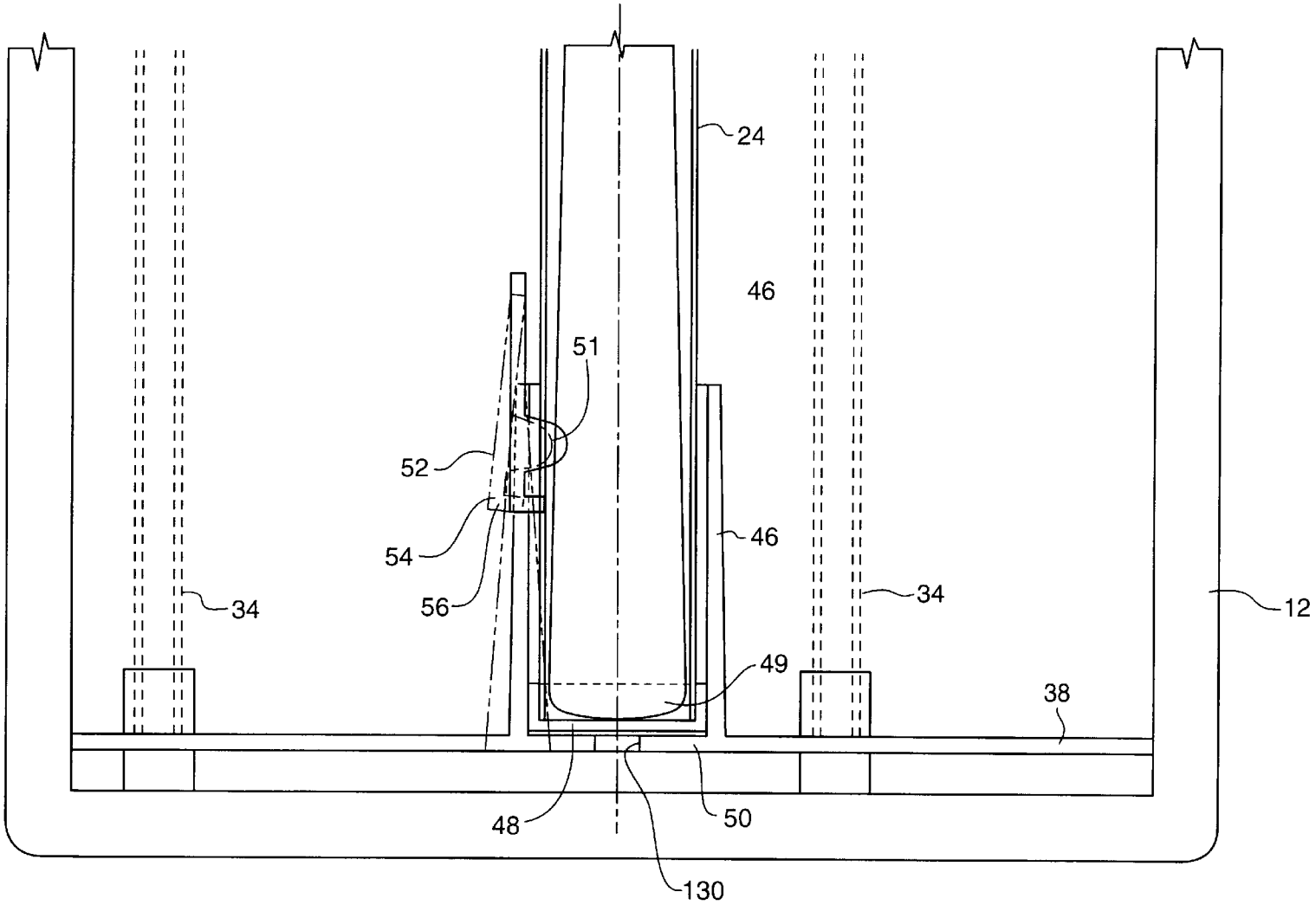
FIG. 8 is an enlarged view of the bottom of the golf bag insert shown in FIG. 3.
Figure 9:
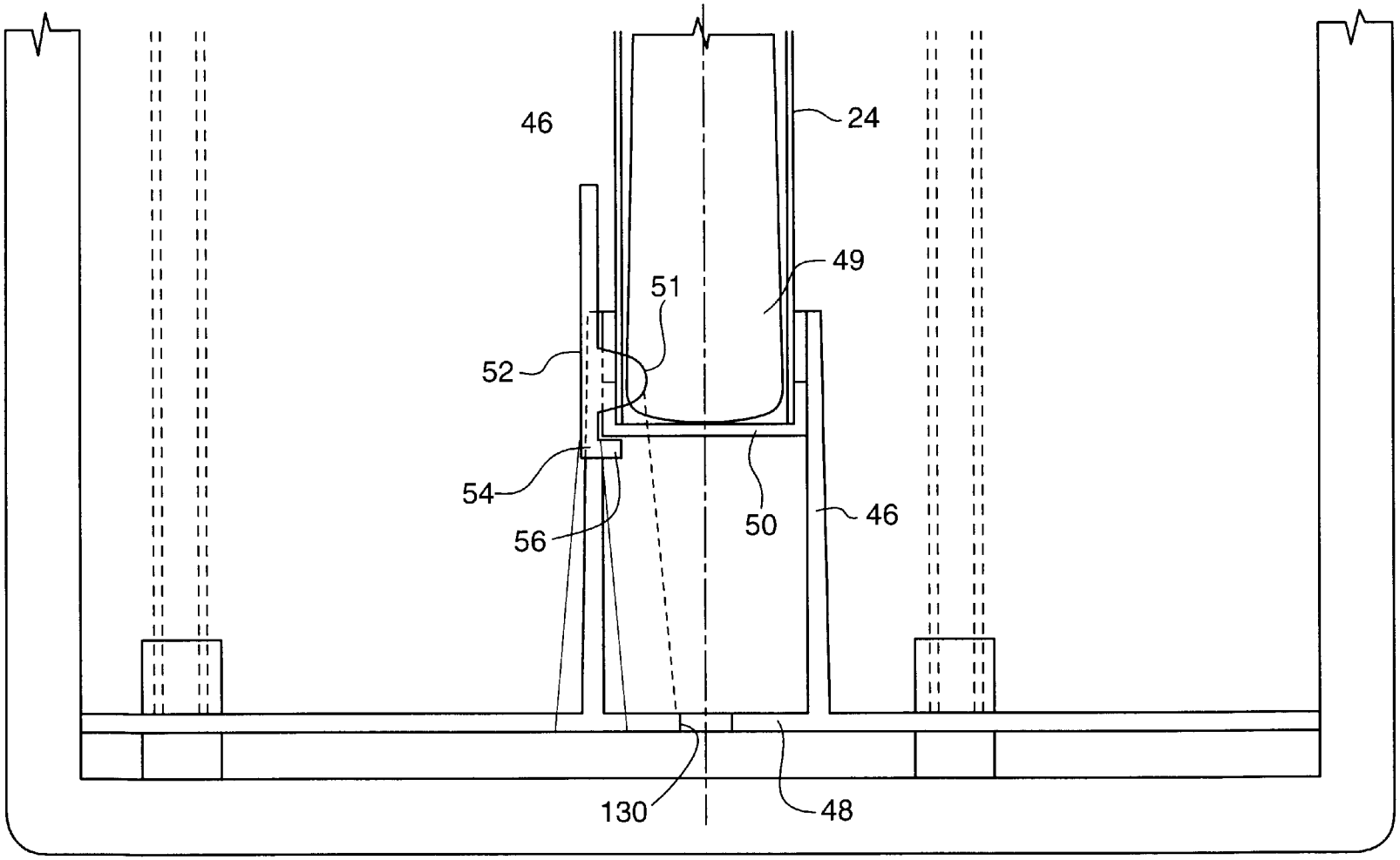
FIG. 9 is an enlarged view of the bottom of the golf bag insert shown in FIG. 4.

As shown in FIGS. 8 and 9, the bottom plate 38 and/or the bottom 48 of the short cylinder 46 is provided with a drain hole 130 to drain any water that may enter the tubular compartment 24.

The golf bag insert of the present invention has a number of advantages, some of which have been described above, and others of which are inherent in the invention.

First of all, the tubular compartments or tubes 24 provide protection for each golf club 26, including the grip 42 and the shaft 33 of the club when it is inserted into the tubular compartment 24.

Next, when the golf club 26 is moved downwardly into the tubular compartment 24, it causes the deflectable members 60 in the tubular compartment 24 to move the protrusions 68 inwardly against the upper tapered end 72 of the grip 42 of the club 26 to lock the club 26 within the tubular compartment 24.

Then, further movement of the tubular compartment or tube 24 and the club 26 deflect the lower deflectable members 52 and protrusions 51 thereon generally outwardly to allow the tubular compartment 24 with a club 26 therein to bottom on the bottom 48 of the short cylinder 46.

When this occurs, the pie-shaped sections 32 move downwardly and engage around the shaft 33 of the club 26 thereby providing a substantially water tight seal around the shaft 33 of the club 26.

Now, when all of the tubular compartments or tubes 24 with clubs 26 therein are moved downwardly, the locking plate 90 can be moved across the bag 12 to move the tabs 92 above the round or lower side 88 of the inclined edges 84 of the upper sections 30 of the tubular compartments 24 whereby they cannot be moved upwardly thereby locking the tubular compartment 24 and the golf club 26 in each tubular compartment 24 in the insert 14 and the bag 12 and prevent removal of any club 26 from the bag 12.

At the same time, the outer tab 106 of the plate 90 moves across the slot 112 and prevents the latch member 114 (similar to a conventional door latch) from being moved downwardly for and out of the slot 112 through the opening 118. This locks the strap 116 to the bag and when the strap 116 is first placed around a bar before the locking occurs, the bag 12 is then locked to the bar.

If desired, the strap 116 could be wire or cable reinforced so that the strap 116 cannot easily be severed if someone tries to steal the bag 12 and that someone cannot simply lift up the golf bag 12 and walk off with it.

Since each of the tubular compartments 24 is mounted in an opening 22 in the closure structure 20, i.e., by means of the cup-shaped closure members 28 and the collars 78 with pins 76 engaging in slots 80 in the upper end sections 30 of the tubular compartments 24, the upper end sections 30 of each of the tubular compartments or tubes 24 are fixed in position thereby to prevent the golf clubs 26 from becoming intertwined with each other. In this way, the golf bag insert 14 of the present invention forms a golf bag organizer.

Another feature of the golf bag insert 14 of the present invention is the fact that the upper end section 30 of each tubular compartment 24 with the inclined upper edge 84 can be made of a contrasting color to the color of the golf bag 12. In this respect, the bag 12 can be colored black, whereas the upper end section 30 of the tubular compartment 24 can be colored orange. In this way, when a club 26 is removed from the bag 12, the golfer knows that there is a golf club 26 missing from one of the compartments 12 because of the showing of the orange upper end section 30 of the tubular compartment 24.

Other advantages of the golf bag insert 14 of the present invention are inherent in the golf bag insert 14.

Also, of course, it will be apparent that modifications can be made to the golf bag insert 14 of the present invention without departing from the teachings of the invention. Accordingly, the scope of the invention is only to be limited as necessitated by the accompanying claims.

I claim:

1. An insert for a golf bag having a generally open top and a generally closed bottom, said insert comprising:

golf club supporting structure in said bag including a compartment for each club; and a closure structure for said generally open top of said bag, said closure structure having an opening for each compartment and including a closure member for each opening at the top of each compartment, and each compartment being constructed and arranged for movement between a lower golf club gripping position and an upper golf club non-gripping position.

2. The golf bag insert of claim 1 wherein each said closure member for closing said opening at the top of one of said compartments includes deflectable closure sections for closing said opening at the top of one of said compartments around a golf club received in said compartment.

3. The golf bag insert of claim 2 wherein each compartment is generally tubular.

4. The golf bag insert of claim 3 wherein said tubular compartments have an upper section with a color which contrasts with the color of the bag.

5. The golf bag insert of claim 3 wherein at least one tubular compartment has an upper section with an inclined upper edge to facilitate upward movement of said at least one tubular compartment against said deflectable sections.

6. The golf bag insert of claim 3 wherein each of said tubular compartments has a bottom and at least one opening in a wall of said compartment at a location above said bottom in alignment with a top of a golf club grip on a club that is inserted to said bottom of said compartment, a deflectable member in said at least one opening having an inwardly extending protrusion and said golf bag insert including a stationary wall structure for engaging said deflectable member when said tubular compartment is moved downwardly to cause said protrusion to move into said tubular compartment in the area of the top or upper section of a golf club grip to hold the club in said tubular compartment.

7. The golf bag insert of claim 3 where each tubular compartment has a bottom and structure at said bottom for engaging with a bottom portion of a golf club to allow the golf club to extend to said bottom.

8. The golf bag insert of claim 3 wherein a collar is mounted in each closure member and has two pins extending inwardly from a wall thereof and said upper section of said tubular compartment has longitudinal slots in a wall thereof for receiving said two pins which are movable therein such that said slots limit upward movement of said tubular compartment when the golf club is moved away from said bottom.

9. The golf bag insert of claim 3 including movable blocking means including blocking structure movable between a blocking position wherein said blocking structure is positioned to engage stop structure on at least one of said tubular compartments to block upward movement of said tubular compartment and a non-blocking position wherein said blocking structure does not engage said stop structure and block upward movement of said tubular compartment.

10. The golf bag insert of claim 9 wherein the bag has a strap or arm sling with a latch at an outer end thereof, said bag has an opening therethrough mating with a slot in said golf bag insert for receiving said latch and said blocking structure in said blocking position also blocks removal of said latch from said slot.

11. The golf bag insert of claim 9 including a locking structure for locking said blocking structure in said blocking position in engagement with said stop structure and a key for locking and unlocking said locking structure.

12. The golf bag insert of claim 9 wherein said blocking structure includes a plate with apertures therein which receive said tubular compartments and said plate having a plate section associated with and extending into each aperture, each said plate section being movable with said plate to a position to engage said stop structure for blocking movement of said tubular compartments.

13. The golf bag insert of claim 12 wherein each tubular compartment has an inclined upper edge defining said stop structure and each said said plate section extending into each aperture is movable with said plate to a position above a lower part of one of said inclined edges.

14. The golf club bag of claim 1 wherein said closure structure has a lateral extent equal to the lateral extent of said generally open top, said closure structure also having a number of said openings equal in number to the number of said compartments and having one of said closure members in each opening, and each closure member comprising an inverted cup shaped closure including a generally cylindrical portion and a plurality of generally pie or wedge shaped sections which are hingedly connected to said cylindrical portion and which together form an opening in the middle of the pie for receiving a shaft of a golf club when said wedge shaped sections are moved inwardly toward a golf club received in one of said compartments.

15. An insert for a golf bag having a generally open top and a generally closed bottom, said insert comprising:

golf club supporting structure in said bag including a compartment for each club; and a closure structure for said generally open top of said bag, said closure structure having an opening for each compartment and a closure member for each opening at the top of each compartment, each closure member having deflectable closure sections, and each compartment being constructed and arranged for movement between a lower golf club gripping position and an upper golf club non-gripping position.

16. An insert for a golf bag having a generally open top and a generally closed bottom, said insert comprising:

golf club supporting structure for being received in said bag, said supporting structure including:

a compartment for each club;

a closure structure for said generally open top of said bag, said closure structure having an opening for each compartment;

each compartment being constructed and arranged for movement between a lower golf club gripping position and an upper golf club non-gripping position;

gripping means associated with each compartment for gripping a golf club when the associated compartment is in a lower position; and, actuating means which cooperate with said gripping means for causing a golf club received in the associated compartment to be gripped when said compartment is in said lower position and to cause a golf club received in said associated compartment to be released when said compartment is in said upper position.

17. The golf bag insert of claim 16 wherein each of said compartments is tubular, has a bottom and at least one opening in a wall of said compartment at a location above said bottom in alignment with a top of a golf club grip on a golf club that is inserted to said bottom of said compartment, said gripping means comprising a deflectable member in said at least one opening having an inwardly extending protrusion and actuating means comprising a stationary wall structure in said golf bag insert for engaging said deflectable member when said tubular compartment is moved downwardly to cause said protrusion to move into said tubular compartment in the area of the top or upper section of a golf club grip to hold the club in said tubular compartment.

18. An insert for a golf bag having a generally open top and a generally closed bottom, said insert comprising:

golf club supporting structure in said bag including a compartment for each club;

a closure structure for said generally open top of said bag, said closure structure having an opening for each compartment, each compartment being movable between an upper golf club removing position and a lower golf club storage position; and, movable blocking structure in said insert movable between a blocking position wherein said blocking structure is positioned to block upward movement of said compartments and a non-blocking position wherein said blocking structure does not block upward movement of said compartments.

19. An insert for a golf bag having a generally open top and a generally closed bottom, said insert comprising:

golf club supporting structure in said bag including a tubular compartment for each club;

each said tubular compartment being movable, at least in part, with movement of a golf club received therein, between a lower position and an upper position;

a closure structure for said generally open top of said bag, said closure structure having a lateral extent equal to the lateral extent of said generally open top and having a number of openings equal in number to the number of said compartments; and, a closure member in each opening, each closure member comprising an inverted cup shaped closure including a generally cylindrical portion and a plurality of generally pie or wedge shaped sections which are hingedly connected to said cylindrical portion and which are movable between an upper open position where a golf club can be removed from said compartment when said compartment is at its upper position and a lower position where said wedge shaped sections form a pie around a golf club with a circular opening in the middle of the pie for receiving a shaft of the golf club, said compartment then being at its lower position, whereby said wedge shaped sections in the lower position substantially close the entire annular space at the top of one of said compartments around a golf club shaft.

* * * * *